United States Patent [19]

Bankar et al.

[11] Patent Number: 4,492,731

[45] Date of Patent: Jan. 8, 1985

[54] TRILOBAL FILAMENTS EXHIBITING HIGH BULK AND SPARKLE

[75] Inventors: Vilas G. Bankar, Seaford; Terry L. Stuchlik, Newark; Frank Werny, Wilmington, all of Del.

[73] Assignee: E. I. Du Pont de Nemours and Company, Wilmington, Del.

[21] Appl. No.: 443,864

[22] Filed: Nov. 22, 1982

[51] Int. Cl.[3] ..... D02G 3/00

[52] U.S. Cl. ..... 428/362; 57/246; 57/248; 428/369; 428/397

[58] Field of Search ..... 428/397, 362, 369, 371; 57/246, 248, 253, 254, 255; 264/177 F, 171

[56] References Cited

U.S. PATENT DOCUMENTS

| | | | |
|---|---|---|---|
| 2,939,201 | 6/1960 | Holland . | |
| 3,097,416 | 7/1963 | McKinney . | |
| 3,508,390 | 4/1970 | Bagnall et al. . | |
| 3,971,202 | 7/1976 | Windley . | |
| 3,994,122 | 11/1976 | Shah . | |
| 4,001,369 | 1/1977 | Shah | 428/397 |

FOREIGN PATENT DOCUMENTS

| | | | |
|---|---|---|---|
| 752770 | 2/1967 | Canada | 428/397 |
| 938768 | 10/1963 | United Kingdom . | |

*Primary Examiner*—Lorraine T. Kendell

[57] ABSTRACT

Trilobal synthetic carpet filaments in a specified range of modification ratios and related arm angles exhibit a unique combination of high bulk and high sparkle.

4 Claims, 2 Drawing Figures

TRILOBAL FILAMENTS EXHIBITING HIGH BULK AND SPARKLE

BACKGROUND OF THE INVENTION

1. Field of the Invention

This invention relates to trilobal carpet filaments combining the aspects of high bulk and high sparkle.

2. Description of the Prior Art

The use of multilobal filaments in continuous filament or staple fiber form, particularly from nylon, for carpet yarn has been widely accepted for many years. U.S. Pat. No. 2,939,201 defined a group of trilobal filaments having improved resistance to soiling. The object of U.S. Pat. No. 3,097,416 was to provide filaments that exhibit a subdued luster, excellent covering power and high resistance to soiling. The Y-shaped synthetic filaments of U.S. Pat. No. 3,508,390 are said to provide an attractive appearance and dry hand in addition to a greater degree of covering power, greater bulk and a higher degree of contrast and pattern definition. U.S. Pat. No. 3,994,122 relates to crimped polyamide staple filament mixtures and yarn therefrom having high bulk and luster while being free of objectionable sparkle. Lastly U.K. Pat. No. 938,768 of 10/9/63 describes a spinning process for making trilobal synthetic filaments. None of the foregoing exemplifies a product having the bulk and sparkle of yarns of the present invention nor are such yarns suggested by the prior art. In general it was found that those prior art products with good sparkle had relatively low bulk and vice versa. The present invention identifies the critical relationship between selected filament cross-section parameters needed to achieve the combination of high bulk with high sparkle.

SUMMARY OF THE INVENTION

This invention provides trilobal filaments of synthetic polymers for carpet yarns of high bulk and high sparkle, said filaments having a cross-section consisting of three substantially equi-spaced, integrally joined arms of substantially similar shape and size, said cross-section having a modification ratio and arm angle within the range represented by the area enclosed by sides A,B,C, and D on FIG. 2 of the drawing.

DETAILED DESCRIPTION

Figure 1:
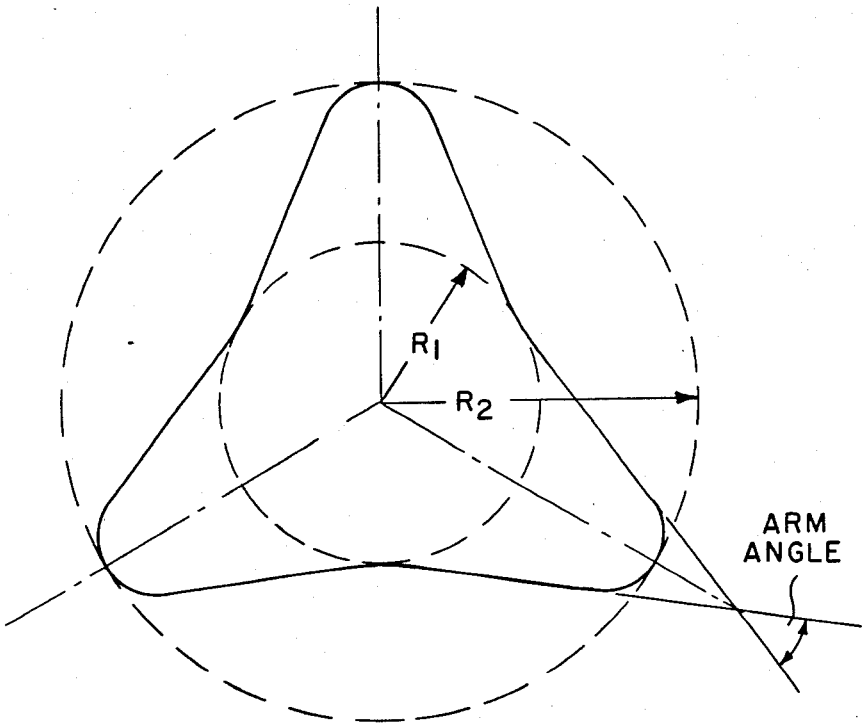
FIG. 1 is an enlarged representation of a cross-section of a filament of this invention.

The term, modification ratio, (MR), means the ratio of the radius $R_2$ of the circumscribed circle to the radius $R_1$ of the inscribed circle as shown in FIG. 1.

The term, arm angle, (AA), is the angle formed by extension of sides of an arm as shown in FIG. 1.

The term, sparkle, means the specks of light perceived on yarn when intense light is directed at the yarn. This is due to minute fiber sections acting as mirrors or as reflecting prisms.

Figure 2:
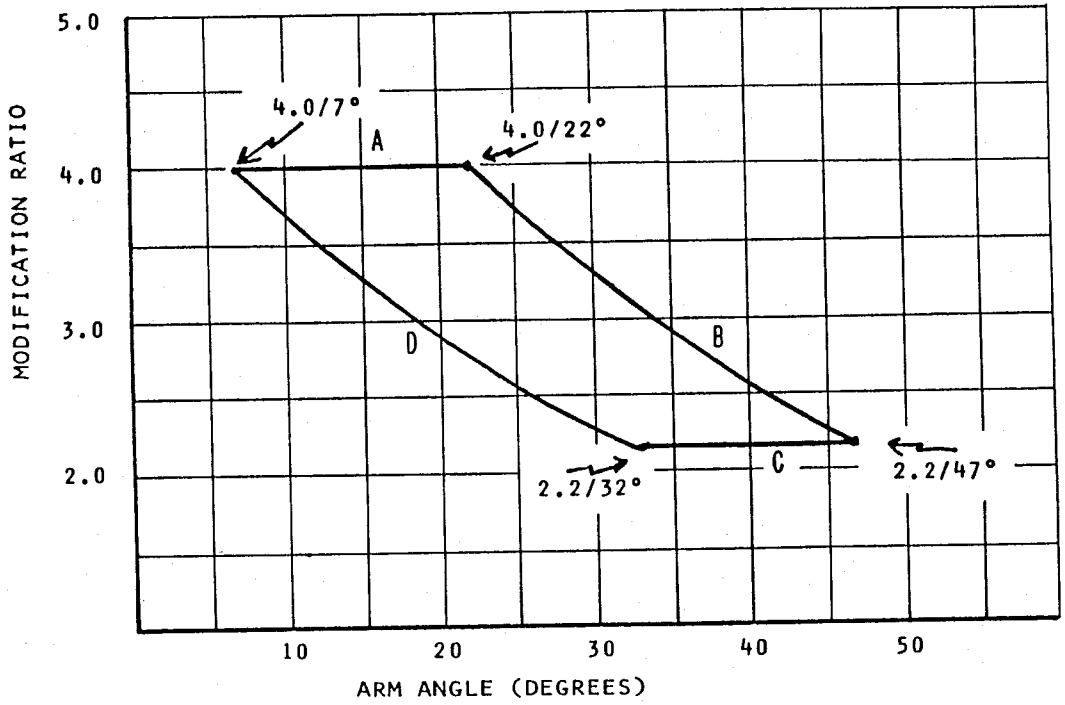
FIG. 2 is a graph showing the area bounded by sides A,B,C, and D which defines limits of the filament cross-section parameters that identify filaments of the present invention.

It has now been found that the combination of both high bulk and high sparkle of the yarns of the invention can be attributed to the use of synthetic polymeric filaments having a modification ratio and arm angle within the area bounded by sides A,B,C, and D in FIG. 2. In a general sense, the modification ratios can range from 2.2 to 4.0 while arm angles from 7° to 47° are useful; however, at both the lower and higher arm angles, only a very limited range of modification ratios will give the novel results. It will be understood by one skilled in the art that filaments of identical configuration but prepared from different synthetic polymers or from polymers having different crystalline or void contents can be expected to exhibit different sparkle. Also level and type of crimp applied will affect bulk. Nevertheless, it is believed that improved sparkle and bulk will be achieved with any synthetic polymeric filament of the now-specified configuration regardless of the particular polymer, and levels or type of crimp selected. The use of polyamides, particularly nylon 6,6, is preferred and conventional additives may be present.

The filaments of the invention are substantially uniform in cross-section along their length. They are crimped in order to provide additional bulk in the yarn. This can be accomplished by any of the well known methods, for example, by use of a stuffer box crimper, a gear crimper or by jet bulking. Since the yarn of this invention is primarily intended for use as carpet yarn, the denier of the individual filaments will be in the range of from 6 to 40, while the yarn denier will be at least about 400.

The filaments of the invention may be prepared by conventional means, that is, molten polymer such as nylon 6,6 is extruded through spinneret orifices, solidified in a quench zone to form filaments which are then drawn and crimped. Apparatus and process suitable for this purpose is shown in Example 1 of U.S. Pat. No. 3,971,202 except that the conductive yarn is omitted. The cross-sectional configuration of the resulting filaments depends on many factors such as the configuration of the spinneret orifice, the relative viscosity of the polymer employed and the quench conditions. The products described in the examples which follow were prepared using the spinning conditions described therein and spinneret orifices of the general type described in FIG. 2 of U.S. Pat. No. 4,001,369 except that the taper angle and arm length were adjusted to yield under the defined spinning conditions, filaments having the expressed modification ratios and arm angles.

EXAMPLE 1

A series of products were made as follows:

Nylon 66 bulked continuous filament yarns were produced using the conditions indicated in Table 1 below. The molten polymer was extruded through spinneret orifices and the molten filaments were solidified in a quench zone, drawn by two sets of moving rolls, heated by a pair of hot rolls, crimped by a jet-screen crimper and wound on a package.

The average measurements of the cross-sectional parameters for each of the samples are indicated in Table 1 below.

TABLE 1

| | Sample Number | | | | |
|---|---|---|---|---|---|
| | A | B | C | D | E |
| Relative viscosity of polymer | 65 | 68 | 63 | 63 | 65 |
| Bundle denier | 1120 | 1400 | 1200 | 1200 | 1700 |
| Denier per filament | 16.5 | 17.5 | 17 | 15 | 18 |
| Quench air flow, $ft^3$/min | 275 | 450 | 350 | 300 | 300 |
| Modification ratio | 2.5 | 2.9 | 2.4 | 3.1 | 2.5 |

TABLE 1-continued

| | Sample Number | | | | |
|---|---|---|---|---|---|
| | A | B | C | D | E |
| Arm angle | 30 | 24 | 29 | 20 | 30 |

Tufted carpets made from these yarns exhibited high bulk and high luster.

EXAMPLE 2

Nylon 66 staple fiber for carpet end-use was produced using the conditions indicated in Table 2 below. Molten nylon 66 was extruded through spinneret orifices and the filaments were quenched in a chimney using cross-flow air. The quenched filaments were then collected as a tow which, in a separate operation, was drawn at a draw ratio of 3.2× and crimped conventionally in a stuffer box crimper and cut. All filaments so prepared are nominally 18 dpf.

TABLE 2

| | |
|---|---|
| Relative viscosity of polymer | 62 |
| Denier per filament | 18 |
| Chimney air flow, $ft^3$/min | 325 |
| Fiber cut length, inches | 7.3 |
| Modification ratio | 3.4 |
| Arm angle | 22 |

Tufted carpets made from the staple yarn showed high sparkle and high bulk.

EXAMPLE 3

Rating of Products

Cut pile carpets were prepared for bulk and sparkle rating as described below.

Yarn (1200 denier) of filaments defined by MR and AA in Table 3 below was two-plied, with 4×4 twists per inch on a cable twister. The yarn was then heat-set on a Superba unit using standard conditions (280° F. in a tunnel). The yarn was tufted on a 5/32 gauge cut pile tufting machine into a Polybac® primary carpet backing. Pile height was ½ inch and 32 oz of yarn were used per square yard of carpet. The tufted carpets were then dyed in a beck with 0.5% Tectilon Yellow 4R (250%). After drying, the bright yellow carpets were latexed, sheared and then cut into hand samples for evaluation.

Bulk Rating

Two samples were chosen as reference points for bulk rating. Item 0 was assigned a value of 15 and item 14 was assigned a value of 5. Higher value indicates higher subjective bulk. A panel of thirteen people was asked to rate the test samples on a scale of 0 (lowest) to 20 (highest) using item 0 and item 14 as reference points. The ratings of each sample were added and divided by the number of persons rating the sample to give an average rating.

Sparkle Rating

Two samples were chosen as references for sparkle rating. Item 4 was assigned a value of 15 and item 14 was assigned a value of 5. Higher value indicates higher sparkle. A panel of thirteen persons was asked to rate the samples on a scale of 0 (lowest) to 20 (highest) using item 4 and item 14 as reference points. The ratings of each sample were added and divided by the number of persons rating the sample to give an average rating.

The results of the bulk and sparkle ratings appear in Table 3 below.

TABLE 3

| | Bulk and Sparkle Evaluations | | | |
|---|---|---|---|---|
| ITEM | MR | AA | SPARKLE | BULK |
| 0 | 3.0 | 14 | 3 | 15 |
| 1 | 2.5 | 31 | 10 | 13 |
| 2 | 1.8 | 36 | 14 | 9 |
| 3 | 4.9 | −2 | 2 | 15 |
| 4 | 1.5 | 45 | 15 | 10 |
| 5 | 2.6 | 16 | 7 | 13 |
| 6 | 3.5 | 11 | 4 | 15 |
| 7 | 1.8 | 47 | 13 | 11 |
| 8 | 2.4 | 29 | 10 | 13 |
| 9 | 3.1 | 20 | 6 | 15 |
| 10 | 1.9 | 42 | 8 | 12 |
| 11 | 3.1 | 23 | 7 | 14 |
| 13 | 2.9 | 10 | 6 | 11 |
| 14 | Round fiber | | 5 | 5 |
| 15 | 1.9 | 47 | 8 | 11 |
| 16 | 2.0 | 30 | 14 | 9 |

It will be seen from the foregoing results that items 1, 8, 9 and 11, corresponding to yarns of crimped filaments of this invention exhibit both high sparkle and high bulk as compared with filaments of similar MR but with lower arm angles. Items 2, 4, 7, 10, 15 and 16 with MR below 2.2 are seen to have lower bulk than any products of the invention. Finally, low arm angles do not provide filaments with adequate sparkle at relatively high modification ratios.

We claim:

1. Trilobal synthetic polymer filaments for carpet yarn having high bulk and high sparkle, said filaments having a cross-section consisting of three substantially equi-spaced, integrally joined arms of substantially similar shape and size, said cross-section having a modification ratio and arm angle within the range represented by the area enclosed by sides A,B,C, and D on FIG. 2 of the drawing.

2. The filaments of claim 1 wherein the synthetic polymer is nylon 6,6.

3. Crimped continuous filament yarn of the filaments of claim 1.

4. Crimped staple fiber yarn of the filaments of claim 1.

* * * * *